US010166582B2

(12) United States Patent
Kunimoto et al.

(10) Patent No.: US 10,166,582 B2
(45) Date of Patent: Jan. 1, 2019

(54) SPINNING METHOD AND SPINNING APPARATUS

(71) Applicants: Yukitaka Kunimoto, Hamamatsu (JP); Satoshi Shionoya, Okazaki (JP); Takashi Yamamoto, Toyota (JP)

(72) Inventors: Yukitaka Kunimoto, Hamamatsu (JP); Satoshi Shionoya, Okazaki (JP); Takashi Yamamoto, Toyota (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 454 days.

(21) Appl. No.: 14/781,816

(22) PCT Filed: Apr. 1, 2014

(86) PCT No.: PCT/IB2014/000537
§ 371 (c)(1),
(2) Date: Oct. 1, 2015

(87) PCT Pub. No.: WO2014/162198
PCT Pub. Date: Oct. 9, 2014

(65) Prior Publication Data

US 2016/0059286 A1 Mar. 3, 2016

(30) Foreign Application Priority Data

Apr. 3, 2013 (JP) ..... 2013-077844

(51) Int. Cl.
*B21B 23/00* (2006.01)
*B21D 22/16* (2006.01)

(52) U.S. Cl.
CPC ..... *B21B 23/00* (2013.01); *B21D 22/16* (2013.01)

(58) Field of Classification Search
CPC ..... B21D 22/14; B21D 22/16; B21D 22/18; B21D 41/04; B21B 23/00
See application file for complete search history.

(56) References Cited

U.S. PATENT DOCUMENTS 6,018,972 A * 2/2000 Irie ..... B21D 22/14 72/120
6,233,993 B1 * 5/2001 Irie ..... B21D 41/04 72/121

(Continued)

FOREIGN PATENT DOCUMENTS

CN 101954401 A 1/2011
CN 101954401 3/2012

(Continued)

OTHER PUBLICATIONS

Combined Chinese Office Action and Search Report dated Aug. 3, 2016 in Patent Application No. 201480019452.2 (Partial English translation only).

(Continued)

*Primary Examiner* — Shelley Self
*Assistant Examiner* — Pradeep C Battula
(74) *Attorney, Agent, or Firm* — Oblon, McClelland, Maier & Neustadt, L.L.P.

(57) ABSTRACT

A spinning method includes supporting a supported portion of a cylindrical work by a work supporting portion. The method includes pressing a roller of a spinning head against an outer peripheral surface of a processed portion of the work while revolving the roller. The method also includes performing a forming process that points a tube axis of the processed portion of the work in a given direction by moving the processed portion relative to the work supporting portion or moving the work supporting portion relative to the processed portion, while making a core bar inserted into the (Continued)

processed portion of the work contact an inner peripheral surface of the processed portion.

8 Claims, 6 Drawing Sheets

(56) References Cited

U.S. PATENT DOCUMENTS

| | | | | |
|---|---|---|---|---|
| 6,381,843 | B1 * | 5/2002 | Irie | F01N 3/2853 72/84 |
| 6,386,010 | B1 * | 5/2002 | Irie | B21D 22/14 72/100 |
| 6,442,988 | B1 | 9/2002 | Hamstra et al. | |
| 6,591,498 | B2 * | 7/2003 | Irie | F01N 3/2853 29/515 |
| 6,766,675 | B2 * | 7/2004 | Suzuki | B21D 22/14 72/121 |
| 6,823,704 | B2 * | 11/2004 | Nakamura | B21D 22/14 72/121 |
| 6,990,841 | B2 * | 1/2006 | Desousa | B21D 22/14 72/101 |
| 8,091,231 | B2 * | 1/2012 | Arito | B21D 22/14 29/508 |
| 8,635,898 | B2 * | 1/2014 | Karino | B21D 41/04 72/120 |
| 2003/0172702 | A1 | 9/2003 | Massee | |
| 2004/0244451 | A1 | 12/2004 | Massee | |

FOREIGN PATENT DOCUMENTS

| | | |
|---|---|---|
| DE | 24 57 504 | 6/1976 |
| EP | 1 302 253 A2 | 4/2003 |
| EP | 1 302 253 A3 | 4/2003 |
| EP | 2 353 744 | 8/2011 |
| JP | 57 112916 | 7/1982 |
| JP | 2000-246353 A | 9/2000 |
| JP | 2001 25826 | 1/2001 |
| JP | 2004-504154 | 2/2004 |
| JP | 2005-519763 | 7/2005 |
| WO | WO 02/07907 A2 | 1/2002 |
| WO | WO 03/076101 A1 | 9/2003 |

OTHER PUBLICATIONS

International Search Report dated Jun. 23, 2014 in PCT/IB2014/000537 Filed Apr. 1, 2014.

* cited by examiner

SPINNING METHOD AND SPINNING APPARATUS

BACKGROUND OF THE INVENTION

1. Field of the Invention

The invention relates to a spinning method and a spinning apparatus suitable to be applied when integrally forming a member having a three-dimensionally complex cylindrical shape, such as an exhaust pipe of a vehicle for example, from a cylindrical work.

2. Description of Related Art

Japanese Patent Application Publication No. 2001-25826 (JP 2001-25826 A), for example, describes one such spinning method that reduces the diameter of a processed portion of a cylindrical work, by pressing approximately two to four rollers against an outer peripheral surface of the processed portion of the work while revolving the rollers, while a cylindrical work is being supported by a chuck or a clamping device.

However, with this kind of spinning method, processing is performed by pressing the rollers from the outside of the work toward the inside of the work (i.e., toward the axis of the work). Therefore, normally, forming beyond the outer shape of the work (i.e., processing to form the axis of the work in a given direction without being limited to the area within the outer shape (the cylindrical shape) of the work), e.g., an offsetting process, is unable to be performed on the work.

SUMMARY OF THE INVENTION

The invention thus provides a spinning method that makes it possible to perform forming beyond the outer shape of the work. The invention also provides a spinning apparatus suitable for implementing such a spinning method.

A first aspect of the invention relates to a spinning method. This spinning method includes supporting a supported portion of a cylindrical work by a work supporting portion; pressing a roller of a spinning head against an outer peripheral surface of a processed portion of the work while revolving the roller; and performing a forming process that points a tube axis of the processed portion of the work in a given direction by moving the processed portion relative to the work supporting portion or moving the work supporting portion relative to the processed portion, while making a core bar inserted into the processed portion of the work contact an inner peripheral surface of the processed portion.

According to this aspect, the forming process that points the tube axis of the processed portion of the work in a given direction is performed in the spinning process that is performed on the cylindrical work. As a result, forming beyond the outer shape of the cylindrical work is able to be performed on the cylindrical work.

Also, in the aspect described above, the spinning method may also include performing an offsetting process in which the tube axis of the processed portion of the work is offset from a tube axis of the supported portion of the work by moving the processed portion of the work relative to the work supporting portion, by moving the work supporting portion or moving the processed portion.

According to this aspect, the offsetting process in which the tube axis of the processed portion of the work is offset from the tube axis of the supported portion of the work is performed. As a result, forming beyond the outer shape of the cylindrical work is able to be performed on the cylindrical work.

Also, in the aspect described above, the forming process may include inclining the tube axis of the processed portion of the work with respect to a tube axis of the supported portion of the work, by appropriately swinging the work supporting portion while the supported portion of the work is supported by the work supporting portion.

According to this aspect, the tube axis of the processed portion of the work is inclined with respect to the tube axis of the supported portion of the work, when the forming process is performed on the cylindrical work. As a result, forming beyond the outer shape of the cylindrical work is able to be performed on the cylindrical work.

Also, in the aspect described above, the core bar may be formed in a shape that fits inside of the processed portion of the work.

According to this aspect, the core bar is formed in a shape that fits inside of the processed portion of the work. Therefore, the work can be formed while maintaining a sectional shape of the processed portion of the work, with this core bar inserted inside the processed portion of the work.

Also, in the aspect described above, a relative position of the core bar and a revolving surface of the roller on an axis of revolution of the roller may be able to be moved.

According to this aspect, the relative position on the axis of revolution of the roller is able to be moved. Therefore, various forming is able to be continuously performed on the work, so productivity improves.

Also, in the aspect described above, the spinning method may also include reducing a diameter of the processed portion of the work by appropriately reducing a revolution diameter of the roller, with the forming process.

According to this aspect, the processed portion of the work is able to be reduced in diameter, with the forming process on the cylindrical work. Therefore, the forming process and the diameter reducing process on the work are simultaneously performed, so productivity improves.

A second aspect of the invention relates to a spinning apparatus. This spinning apparatus includes a work supporting portion that supports a supported portion of a cylindrical work; a plurality of rollers of a spinning head that are pressed against an outer peripheral surface of the processed portion of the work while being revolved; and a core bar provided, so as to be able to advance and retreat in a rotational axis direction of a spindle of the spinning head, in a position surrounded by the rollers. The plurality of rollers are provided at substantially equiangular intervals on a circumference of a circle that is centered around a rotational axis of the spindle. The core bar is inserted in the processed portion of the work and contacts an inner peripheral surface of the processed portion. The core bar moves relative to the work supporting portion or the work supporting portion moves relative to the core bar while the core bar is contacting the inner peripheral surface of the processed portion.

According to this aspect, effects similar to those obtained by the first aspect of the invention are able to be obtained.

Also, in the aspect described above, the work supporting portion may be configured such that an offsetting process, in which a tube axis of the processed portion of the work is offset from a tube axis of the supported portion of the work by the processed portion of the work being moved relative to the work supporting portion, is performed by the work supporting portion of the work or the core bar being moved.

According to this aspect, effects similar to those obtained by the first aspect of the invention, as well as the aspects accompanying the first aspect, are able to be obtained.

Also, in the aspect described above, the work supporting portion may swing such that a tube axis of the processed portion of the work is inclined with respect to a tube axis of the supported portion of the work.

According to this aspect, effects similar to those obtained by the first aspect of the invention, as well as the aspects accompanying the first aspect, are able to be obtained.

Also, in the aspect described above, the core bar may be formed in a shape that fits into the processed portion of the work.

According to this aspect, effects similar to those obtained by the first aspect of the invention, as well as the aspects accompanying the first aspect, are able to be obtained.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Hereinafter, example embodiments of the invention will be described.

First Example Embodiment of the Invention

Figure 1A:
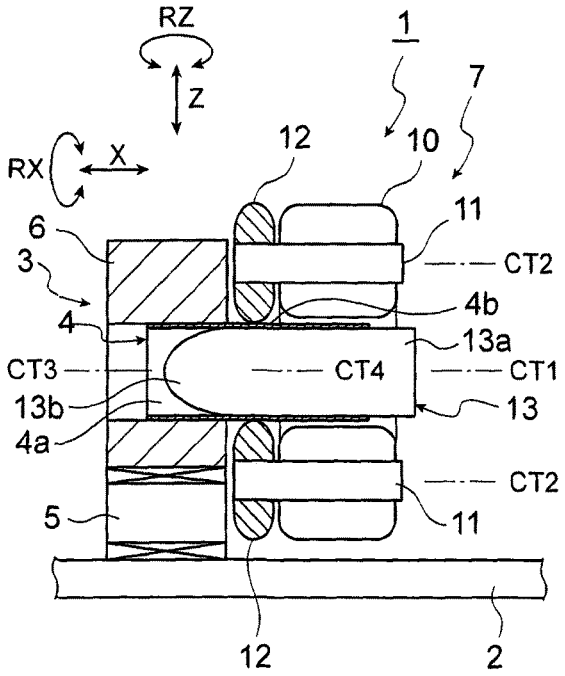
FIG. 1A is a front view of a spinning apparatus, and illustrates processes from a work preparation process to a roller contact process of a spinning method according to a first example embodiment of the invention.

FIGS. 1A to 4 are views of a first example embodiment of the invention. FIG. 1A is a sectional view of a roller and the like taken along line IA-IA in FIG. 1B. A spinning apparatus 1 according to the first example embodiment includes a table 2 that is arranged horizontally, as shown in FIG. 1A. A work support base 3 that serves as a work supporting portion is attached onto the table 2 in such a manner as to be able to move in three axis directions (i.e., an X direction, a Y direction, and a Z direction), as well as swing around an axis in the X direction (i.e., in a RX direction), around an axis in the Y direction (i.e., in a RY direction), and around an axis in the Z direction (i.e., in a RZ direction), while supporting a cylindrical work 4. This work support base 3 is formed by a base 5 and a chuck 6. That is, the base 5 is supported so as to be able to move in three axis directions (i.e., the X direction, the Y direction, and the Z direction), on the table 2. The chuck 6 that is able to grip the work 4 is mounted onto the base 5 so as to be able to swing around an axis in the X direction (i.e., the RX direction), an axis in the Y direction (i.e., the RY direction), and an axis in the Z direction (i.e., the RZ direction).

Also, a spinning head 7 is arranged near (to the right in FIG. 1A) the work support base 3. The spinning head 7 is formed by a spindle base, not shown, a spindle 10, three support shafts 11, and three rollers 12 and the like (see FIG. 1B).

Figure 1B:
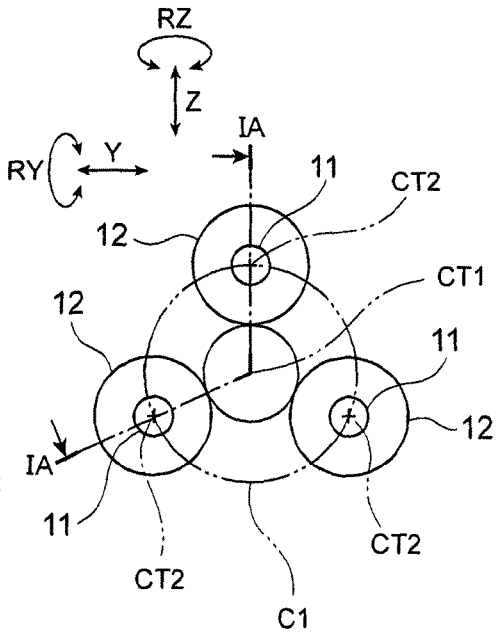
FIG. 1B is a right side view of a spinning head, and illustrates the processes from the work preparation process to the roller contact process of the spinning method according to the first example embodiment of the invention.

That is, the spindle base, not shown, is provided upright on the table 2. The annular spindle 10 is supported, in a manner so as to be able to rotate about a rotational axis CT1 by driving means, not shown, in a position facing the chuck 6, as shown in FIG. 1A, on a side surface of the spindle base. Together with the spindle 10, the three support shafts 11 are arranged at equiangular intervals (i.e., 120° intervals) on a circumference of a circle C1 that is centered around the rotational axis CT1, as shown in FIG. 1B. These support shafts 11 are configured so as to be able to move in the radial direction of the spindle 10. The rollers 12 are supported, in a manner so as to be able to rotate about axes CT2 of the support shafts 11, on the support shafts 11.

Furthermore, a generally pencil-shaped core bar (a mandrel) 13 of which an axis CT4 is positioned on the rotational axis CT1 of the spindle 10, i.e., the axis of revolution of the rollers 12, is attached to the spindle 10 in a manner so as to be able to advance and retreat in the direction of the rotational axis CT1 of the spindle 10 (i.e., the left-right direction in FIG. 1A). This core bar 13 has a circular cylindrical-shaped core bar main body 13*a*, and a tip end portion 13*b* that is connected consecutively to one end of this core bar main body 13*a*. A diameter of the core bar main body 13*a* is formed to be substantially the same size as an inside diameter of the work 4. Therefore, the core bar main body 13*a* is shaped so that it fits inside a processed portion 4*b* of the work 4.

Figure 4:
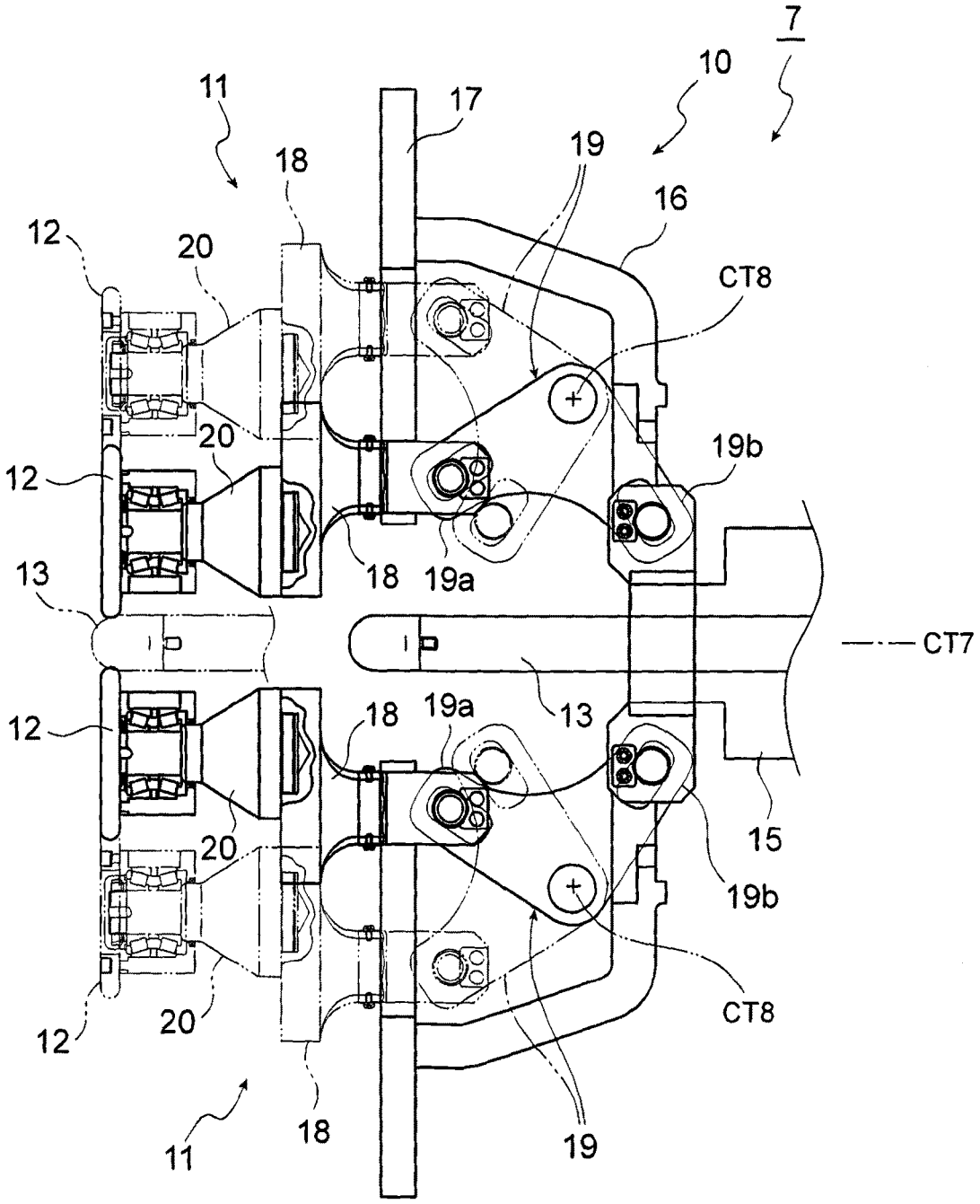
FIG. 4 is a front sectional view of the specific structure of the spinning head of the spinning apparatus according to the first example embodiment of the invention.

More specifically, the spinning head 7 is such that the spindle 10 is formed by a housing 16 and a faceplate 17, and the support shafts 11 are formed by sliders 18 and roller holders 20, as shown in FIG. 4.

That is, this spinning head 7 has a main shaft 15 that is supported horizontally, as shown in FIG. 4. The housing 16 is attached to the main shaft 15 in a manner so as to be able to rotate about an axis CT7 of the main shaft 15. The annular faceplate 17 is fixed to the housing 16 such that a surface of the faceplate 17 is perpendicular to the axis CT7 of the main shaft 15, and the center of the faceplate 17 is aligned with the axis CT7. The three sliders 18 are arranged on the faceplate 17 at equiangular intervals (i.e., 120° intervals) on the circumference of a circle that is centered around the center of the faceplate 17, i.e., the axis CT7 of the main shaft 15. Each of the sliders 18 is configured to be able to move in the radial direction of the faceplate 17 by pivoting a boomerang-shaped slide ring 19 with driving means, not shown, as indicated by the solid lines and alternate long and two short dashes lines in FIG. 4. That is, each of the slide rings 19 is supported in a manner so as to be able to rotate about a predetermined rotational axis CT8. The slider 18 is connected to one end 19*a* of the slide ring 19, and the driving means is connected to the other end 19*b* of the slide ring 19. The slider 18 is then able to be moved in the radial direction of the faceplate 17 by moving the other end 19*b* of the slide ring 19 in the horizontal direction using the driving means. Also, one roller holder 20 is fixed to each slider 18. One roller 12 is rotatably supported by each roller holder 20. Moreover, the core bar 13 is attached to the main shaft 15 in a manner so as to be able to advance and retreat in the direction of the axis CT7 of the main shaft 15 (i.e., in the left-right direction in FIG. 4).

Figure 1C:
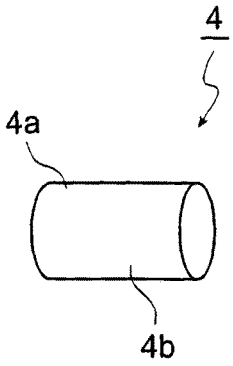
FIG. 1C is a perspective view of a work before being processed, and illustrates the processes from the work preparation process to the roller contact process of the spinning method according to the first example embodiment of the invention.

The spinning apparatus 1 is configured as described above, so the procedure for performing spinning on the work 4 that is cylindrical as shown in FIG. 1C using this spinning apparatus 1 is as described below.

First, in a work preparation process, a supported portion 4*a* of the work 4 is gripped by the chuck 6 of the work support base 3, as shown in FIG. 1A, while the three support shafts 11 are farthest away from the rotational axis CT1 of the spindle 10 in the radial direction of the spindle 10, and the core bar 13 is retreated to the spinning head 7 side. As a result, the work 4 is in a state supported horizontally with an axis CT3 thereof aligned with the rotational axis CT1 of the spindle 10.

Next, a core bar insertion process is performed. In this process, the core bar 13 is advanced toward the work support base 3 side with respect to the work 4. Accordingly, the core bar 13 is inserted inside of the processed portion 4*b* of the work 4. As a result, the core bar 13 fits into the processed portion 4*b* of the work 4, just as described above, so the outer peripheral surface of the core bar main body 13*a* contacts the entire inner peripheral surface of the processed portion 4*b* of the work 4.

Then a roller contact process is performed. In this process, the three support shafts 11 are moved toward the rotational axis CT1 of the spindle 10 in the radial direction of the spindle 10. As a result, the three rollers 12 contact the outer peripheral surface of the work 4. At this time, the three support shafts 11 are arranged at equiangular intervals on the circumference of the circle C1 that is centered around the rotational axis CT1 of the spindle 10, just as described above. Therefore, the three rollers 12 are also arranged at equiangular intervals around the work 4.

Continuing on, an offsetting process is performed. In this process, the spindle 10 is rotated about the rotational axis CT1. As a result, the three rollers 12 revolve at a predetermined rotation rate with the rotational axis CT1 as the center of rotation, and the core bar 13 synchronously spins at the same rotation rate with the rotational axis CT1 as the center of rotation. As a result, the rollers 12 revolve around the work 4 while spinning with respect to the outer peripheral surface of the processed portion 4*b* of the work 4. Also, the core bar 13 spins while contacting the inner peripheral surface of the processed portion 4*b* of the work 4.

Figure 2A:
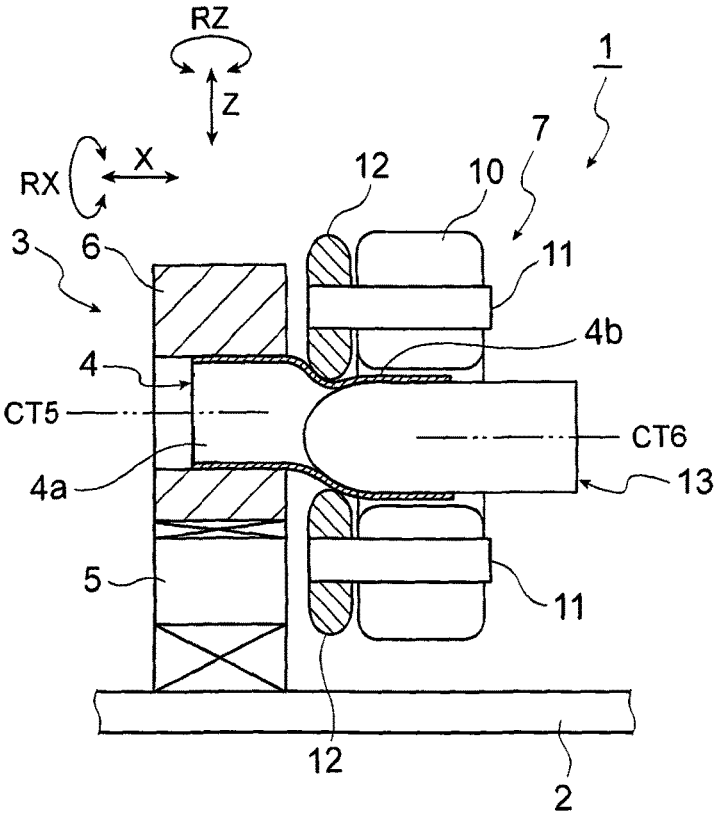
FIG. 2A is a front view of the spinning apparatus, and illustrates an offsetting process of the spinning method according to the first example embodiment of the invention.
Figure 2B:
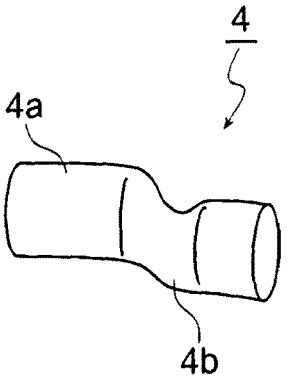
FIG. 2B is a perspective view of a target shape of the work in the offsetting process of the spinning method according to the first example embodiment of the invention, and illustrates this offsetting process.

In this state, the work support base 3 is moved upward in the Z direction, as shown in FIG. 2A. As a result, the supported portion 4*a* of the work 4 rises (i.e., moves upward) while the processed portion 4*b* of the work 4 remains in the original position. Therefore, an offsetting process in which a tube axis CT5 of the supported portion 4*a* is offset upwards from a tube axis CT6 of the processed portion 4*b* is performed. As a result, forming beyond the outer shape of the work 4 is able to be performed, as shown in FIG. 2B.

At this time, the outer peripheral surface of the core bar main body 13*a* of the core bar 13 is contacting the entire inner peripheral surface of the processed portion 4*b* of the work 4, just as described above. Therefore, the work is able to be formed while maintaining the sectional shape (circular shape) of the processed portion 4*b* of the work 4.

Figure 3A:
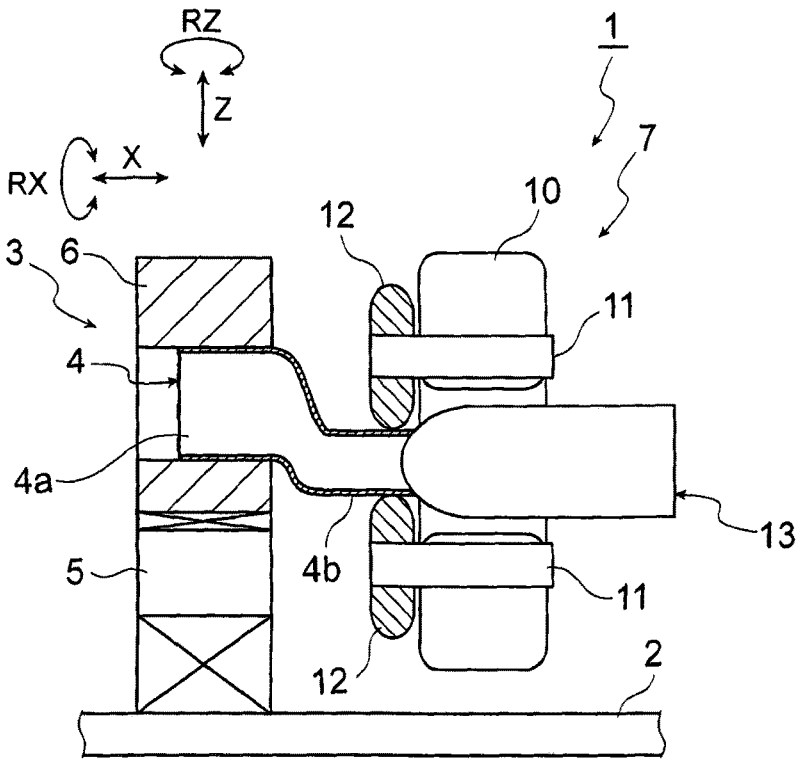
FIG. 3A is a front view of the spinning apparatus, and illustrates a diameter reducing process of the spinning method according to the first example embodiment of the invention.
Figure 3B:
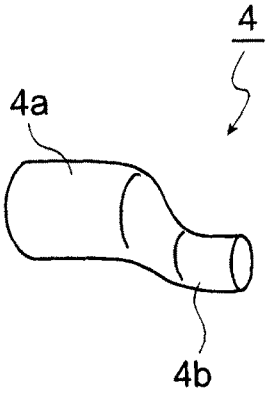
FIG. 3B is a perspective view of a target shape of the work in the diameter reducing process of the spinning method according to the first example embodiment of the invention, and illustrates this diameter reducing process.

Finally, a diameter reducing process is performed. In this process, the three rollers 12 are moved toward the center in the radial direction of the spindle 10, and the work support base 3 is moved away from the spinning head 7 in the X direction, as shown in FIG. 3A. As a result, the processed portion 4*b* of the work 4 is reduced in diameter by the rollers 12, as shown in FIG. 3B. At this time, the core bar 13 comes out from the processed portion 4*b* of the work 4 as the work support base 3 moves. Therefore, the process of reducing the diameter of the processed portion 4*b* of the work 4 is able to be performed smoothly.

With this, the spinning process performed on the work 4 ends.

In this way, in the spinning process on the cylindrical work 4, forming beyond the outer shape of the work 4 is made possible by moving the core bar 13 that is inserted into the processed portion 4*b* of the work 4 and performing the offsetting process.

Also, the relative position of the core bar 13 and a revolving surface of the roller 12 on the axis of revolution of the rollers 12 is able to be moved. Therefore, various forming is able to be continuously performed on the work 4 when the spinning process is performed on the work 4, so productivity improves.

Furthermore, the work support base 3 is able to swing around the axis in the X direction (i.e., the RX direction), the axis in the Y direction (i.e., the RY direction), and the axis in the Z direction (i.e., the RZ direction), just as described above. When spinning the work 4, the work support base 3 is swung appropriately according to the processing shape of the processed portion 4*b* of the work 4, while the supported portion 4*a* of the work 4 is supported by the work support base 3. Accordingly, the tube axis CT6 of the processed portion 4*b* of the work 4 is also able to be inclined with respect to the tube axis CT5 of the supported portion 4*a* of the work 4. As a result, it becomes possible to suitably bend the work 4 in a three-dimensional direction.

Second Example Embodiment of the Invention

Figure 5:
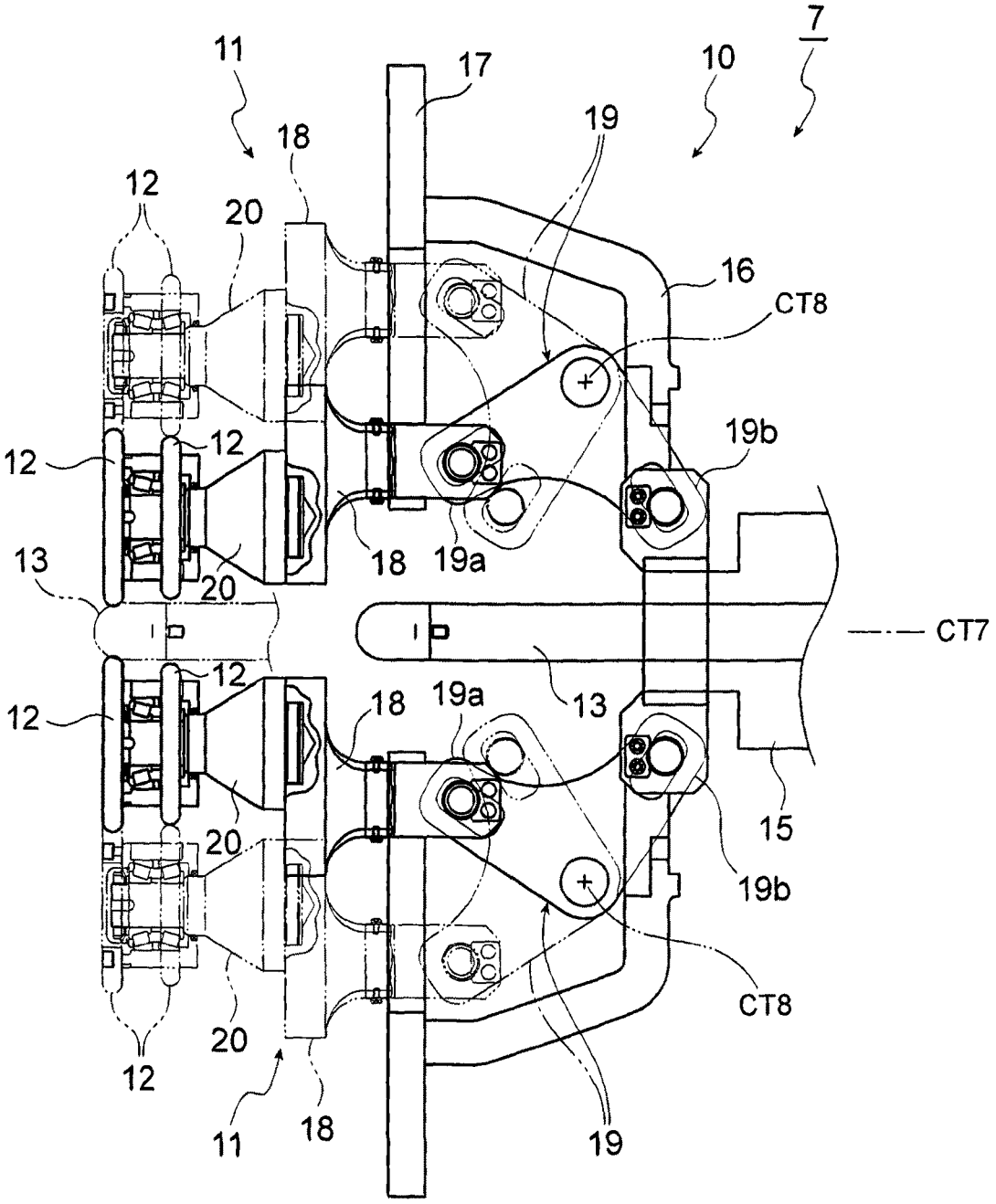
FIG. 5 is a front sectional view of the specific structure of a spinning head of a spinning apparatus according to a second example embodiment of the invention.

FIG. 5 is a view of a second example embodiment of the invention. The spinning head 7 of the spinning apparatus 1 according to the second example embodiment has a structure similar to that in the first example embodiment described above, except for that two rollers 12 are installed on each of the support shafts 11 (i.e., roller holders 20), as shown in FIG. 5. Members in the second example embodiment that are the same as members in the first example embodiment will be denoted by like reference characters and descriptions of these members will be omitted. Also, the procedure of the spinning method of the work 4 is also the same as it is in the first example embodiment described above.

Therefore, this second example embodiment displays similar operation and effects as those displayed by the first example embodiment described above. In addition, in the spinning process on the work 4 (i.e., in the offsetting process and the diameter reducing process), the contact area between the rollers 12 and the work 4 increases according to the increase in the number of rollers 12. Therefore, the spinning process on the work 4 is able to be performed quickly and highly accurately.

Third Example Embodiment of the Invention

FIG. 6 is a view of a third example embodiment of the invention. In the first and second example embodiments described above, the spinning apparatus 1 provided with the core bar 13 is described. The shape of this core bar 13 may be any shape suited to shaping the work 4 by spinning.

Figure 6A:
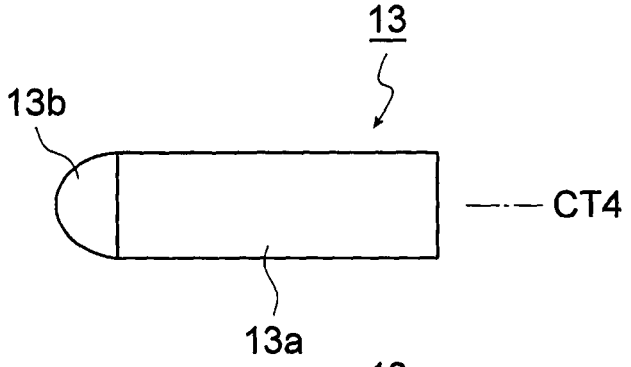
FIG. 6A is a front view of a modified example of a core bar of a spinning apparatus according to a third example embodiment of the invention.

For example, a standard-type core bar 13 in which a semispherical tip end portion 13*b* is connected continuously to one end of a circular cylindrical core bar main body 13*a* may instead be used, as shown in FIG. 6A. This standard-type core bar 13 is suitable for use when the bending point of the work 4 is comparatively close.

Figure 6B:
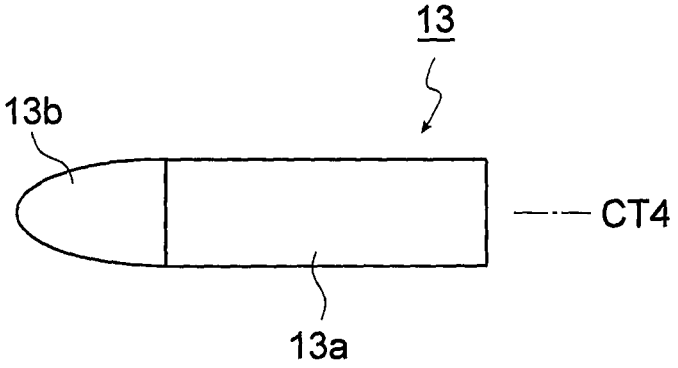
FIG. 6B is a front view of a modified example of the core bar of the spinning apparatus according to the third example embodiment of the invention.

Also, a long-type core bar 13 in which the tip end portion 13*b* is shaped like half of a spheroid (a long spheroid) is connected continuously to one end of the circular cylindrical core bar main body 13*a* may instead be used, as shown in FIG. 6B. Using this long-type core bar 13 enables a beautiful work 4 with few irregularities on the outer peripheral surface to be obtained when the inner diameter after of the work 4 after the diameter reducing process is small and the area over which the inner diameter is changed in steps is large.

Figure 6C:
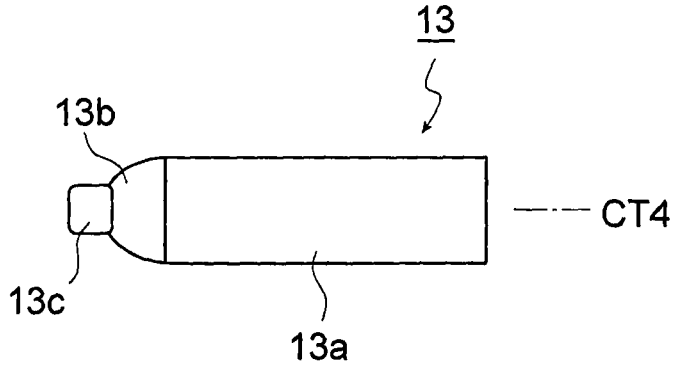
FIG. 6C is a modified example of the core bar of the spinning apparatus according to the third example embodiment of the invention.

Moreover, a stepped-type core bar 13 in which a small diameter circular cylindrical-shaped small diameter corresponding portion 13*c* is attached to an apex portion of the tip end portion 13*b* of a standard-type core bar 13, as shown in FIG. 6C. Using this stepped-type core bar 13 enables the small diameter corresponding portion 13*c* of the core bar 13 to make contact from the inner peripheral surface of the work 4 and thus provide reaction force with respect to force that acts on the outer peripheral surface of the work 4 from the rollers 12 when spinning the work 4, when high diameter dimensional accuracy is required at the formed end portion of the work 4 (for example, when a mating part is to fit with this formed end portion). As a result, the processing accuracy of the work 4 is able to be increased.

Other Example Embodiments of the Invention

In the first to the third example embodiments described above, a spinning head 7 configured such that the housing 16 is rotatably attached to the main shaft 15 is described. However, a structure in which the main shaft 15 rotates together with the housing 16 may also be employed. In this case, providing a lock-unlock switching mechanism, not shown, between the main shaft 15 and the core bar 13 would make it possible to appropriately select between making the core bar 13 follow the rotation of the main shaft 15 (when locked), and making the core bar 13 not follow the rotation of the main shaft 15 (when unlocked), according to the type of processing of the work 4. This would make it possible to handle a variety of types of processing of the work 4. Also, in the first to the third example embodiments described above, a case is described in which an offsetting process is performed on the work 4 by moving the work support base 3 upward in the Z direction in the spinning process (i.e., the offsetting process) of the work 4. However, the offsetting process may also be performed on the work 4 by lowering the spinning head 7 and moving the processed portion 4*b* of the work 4 downward while the core bar 13 is inserted in the processed portion 4*b* of the work 4, instead of moving the work support base 3 upward in the Z direction. That is, the processed portion 4*b* of the work 4 need only be moved in the vertical direction relative to the work support base 3. Alternatively, the processed portion 4*b* of the work 4 may be moved in the left-right direction relative to the work support base 3 side.

Also, in the first to third example embodiments described above, a spinning head 7 in which the three support shafts 11 are arranged at equiangular intervals (120° intervals) is described. However, the number of support shafts 11 is not limited to three. Also, when there is a plurality of support shafts 11, it is not absolutely necessary that they be arranged at equiangular intervals.

Further, in the first example embodiment described above, a spinning head 7 in which one roller 12 is installed on each support shaft 11 is described, and in the second example embodiment described above, the spinning head 7 in which two rollers 12 are installed on each support shaft 11 is described. However, the number of rollers 12 installed on each support shaft 11 is not limited to one or two. That is, three or more rollers 12 may also be installed on each support shaft 11.

Also, in the first to the third example embodiments described above, a spinning head 7 configured such that the rollers 12 are rotatably supported by the support shafts 11, and these rollers 12 spin against the outer peripheral surface of the work 4 when spinning the work 4, is described. However, the structure may also be such that the rollers 12 are fixed to the support shafts 11, and the rollers 12 slide against the outer peripheral surface of the work 4 when spinning the work 4.

Further, in the first to the third example embodiments described above, a case in which an offsetting process is performed on the work 4 when spinning the work 4, is described. However, the invention is not limited to this kind of offsetting process. That is, a forming process that points the tube axis CT6 of the processed portion 4*b* of the work 4 in a given direction may also be performed. This enables a variety of members having complex cylindrical shapes to be integrally formed from the cylindrical work 4.

Moreover, the processed portion 4*b* of the work 4 may also be reduced in diameter by suitably reducing the revolution diameter of the rollers 12 with the forming process to point the tube axis CT6 of the processed portion 4*b* of the work 4 in a given direction. In this case, the forming process to point the tube axis CT6 of the processed portion 4*b* of the work 4 in the given direction, and the diameter reducing process are performed simultaneously. As a result, productivity is able to be increased.

Also, in the first to the third example embodiments described above, a spinning apparatus 1 provided with one core bar 13 that has a shape enabling it to fit into the processed portion 4*b* of the work 4 is described. However, the shape and number of the core bar 13 is not particularly limited as long as the processed portion 4*b* of the work 4 is able to move relative to the work support base 3 side. For example, a plurality (two or more) core bars 13 each having a diameter approximately ⅓ the inside diameter of the work 4 may be attached to the spindle 10 such that the axis of each of the core bars 13 is offset by an equal distance from the rotational axis CT1 of the spindle 10. At this time, performing control to maintain a positional relationship in which the core bar 13 is always facing the inside of the rollers 12 (i.e., side where the axis of revolution of the rollers 12 is located) across the work 4 enables the core bar 13 to make contact from the inner peripheral surface of the work 4 and thus provide reaction force with respect to force that acts on the outer peripheral surface of the work 4 from the rollers 12, when the rollers 12 revolve in the spinning process on the work 4. As a result, the processing accuracy, of the work 4 is able to be increased.

The invention is extremely useful when integrally forming a member having a three dimensionally complex cylindrical shape, more specifically, a surge tank, a separation tank of a turbocharger, a muffler for a two-wheel vehicle, a catalytic converter, a diesel exhaust treatment device (i.e., a diesel particulate filter), and various pressure containers and the like, from cylindrical material by spinning.

The invention claimed is:

1. A spinning method comprising:

supporting a supported portion of a cylindrical work by a work supporting portion; pressing a roller of a spinning head against an outer peripheral surface of a processed portion of the work while revolving the roller; and performing a forming process that points a tube axis of the processed portion of the work in a given direction by moving the roller relative to the work supporting portion and moving a core bar relative to the roller such that a cooperation between the core bar and the roller reduces a diameter of the processed portion along a shape of a distal end portion of the core bar, while making the core bar inserted into the processed portion of the work contact an inner peripheral surface of the processed portion, and bringing the roller into contact with the outer peripheral surface of the processed portion positioned at a tapered portion of the distal end portion of the core bar.

2. The spinning method according to claim 1, further comprising:

performing an offsetting process in which the tube axis of the processed portion of the work is offset from a tube axis of the supported portion of the work by moving the roller relative to the work supporting portion and moving the core bar relative to the roller.

3. The spinning method according to claim 2, wherein the forming process includes inclining the tube axis of the processed portion of the work with respect to the tube axis of the supported portion of the work, by appropriately swinging the work supporting portion while the supported portion of the work is supported by the work supporting portion.

4. The spinning method according to claim 1, wherein the forming process includes inclining the tube axis of the processed portion of the work with respect to a tube axis of the supported portion of the work, by appropriately swinging the work supporting portion while the supported portion of the work is supported by the work supporting portion.

5. The spinning method according to claim 1, wherein the core bar is formed in a shape that fits inside of the processed portion of the work.

6. The spinning method according to claim 1, wherein a relative position of the core bar and a revolving surface of the roller on an axis of revolution of the roller is able to be moved.

7. The spinning method according to claim 1, further comprising: reducing a diameter of the processed portion of the work by appropriately reducing a revolution diameter of the roller, with the forming process.

8. The spinning method according to claim 1, wherein:

the core bar moves relative to the roller in an axial direction of the spinning head.

* * * * *